United States Patent [19]

Brugger

[11] Patent Number: 4,722,543

[45] Date of Patent: Feb. 2, 1988

[54] SKI

[75] Inventor: Hubert Brugger, Götzis, Austria

[73] Assignee: Head Sportgeräte Gesellschaft m.b.H & Co.OHG., Wuhrkopfweg, Austria

[21] Appl. No.: 746,487

[22] Filed: Jun. 19, 1985

[30] Foreign Application Priority Data

Jun. 19, 1984 [AT] Austria ..... 2004/84

[51] Int. Cl.[4] ..... A63C 5/04

[52] U.S. Cl. ..... 280/609; 280/610

[58] Field of Search ..... 280/609, 610

[56] References Cited

U.S. PATENT DOCUMENTS 4,433,855 2/1984 Wyke ..... 280/609

FOREIGN PATENT DOCUMENTS 371728 7/1983 Austria .
1132474 6/1962 Fed. Rep. of Germany ..... 280/609
2525471 12/1975 Fed. Rep. of Germany .
628308 11/1961 Italy ..... 280/609
55063 4/1935 Norway ..... 280/609

*Primary Examiner*—Nancy Swisher
*Attorney, Agent, or Firm*—Millen & White

[57] ABSTRACT

In a ski being equipped with metal edges, the tread (2) has, as seen in a cross section, a horizontally extending central area (2') and at both sides thereof lateral areas (4) extending in upward direction and being rigidly connected with the ski. The width of the central area (2'), extending, as seen in a cross section, in a horizontal plane, of the tread (2) is greater than the total width of the chamferred and upwardly extending areas (4) and the tangent lines applied to the lateral areas (4), extending at least over the width of the steel edges, and normally extending relative to the longitudinal direction of the ski include one with the other an obtuse angle of 170° to 179°, preferably 174° to 178°, having its apex located below the tread (2) in the vertical longitudinal center plane (6) of the ski. The width of an upwardly extending lateral area (4) of the tread (2) is smaller than 10 mm. This width can approximately correspond to the width of a steel edge.

8 Claims, 3 Drawing Figures

FIG. 1
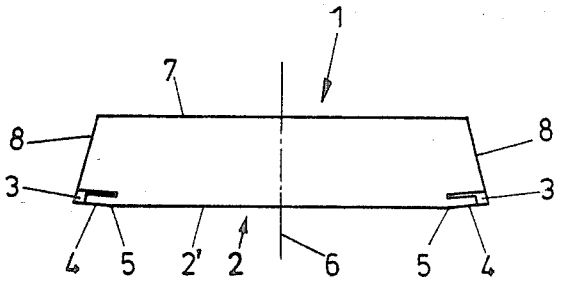
FIG. 2
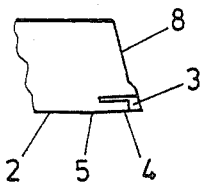
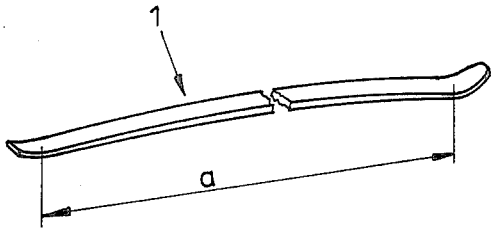
FIG. 3

SKI

BACKGROUND OF THE INVENTION (1) Field of the Invention

The instant invention relates to skis, more particularly the instant invention refers to a ski comprising a tread and metal edges arranged at the lateral margins of the tread.

(2) Prior Art

Skis comprising a tread and metal edges arranged at the enteral margins of the tread are, as a rule, equipped with a substantially flat tread, noting that an approximately centrally arranged groove extending in longitudinal direction of the ski is, as a rule, provided for improving the guiding properties. For improving the sliding properties, there were developed materials suitable as a cover layer for the tread. In connection with sharpened edges it has frequently considered a drawback that already a minor ineptitude of loading the ski results in an excessive loading of the edge and thus in canting of the ski. In particular in connection with correspondingly hard long skis of high vibration-attenuating properties, there was observed, as a rule, an only low tendency to follow swinging movement if the edges were sharp and it was for this reason that such skies were primarily suitable for down-hill skiing. A somewhat increased capability of the skis to follow swinging movements without having to renounce the possibility to heavily apply the ski edges to an icy or hard runway is, however, desireable for the average skier.

From DE-OS No. 25 25 471, there has become known a ski, the tread of which has, as seen in a cross section, a central area extending in a horizontal plane and at both sides of said central area lateral areas extending in upward direction. The width of the central area is comparatively small and approximately corresponds to the total width of both lateral areas extending in upward direction. The lateral areas extending in upward direction have a very steep chamfer and include, as seen in a cross section, an angle of approximately 140° one with the other. These steeply chamferred lateral areas thus do not contribute anything for guiding the ski when running straight ahead and this results in a high uncertainty when running straight ahead. During swinging movement, the steel edges of these lateral areas having a chamfer extending in upward direction come into engagement with the runway only if the ski is canted for a considerably angle, so that swinging movements are not facilitated with such a ski.

SUMMARY OF THE INVENTION

It is an object of the invention to design such a ski, being equipped with metal edges and having its tread, as seen in a cross section, provided with a central area extending in a horizontal plane and at both sides of this area with upwardly extending lateral areas rigidly connected with the central area, such that it is still possible to make full use of the ski edges and thus to effect swinging movement in the habitual reliable manner and that, however, the capability of the ski to effect swinging movement on the runway is facilitated, noting that a reliable guiding effect is warranted when running straight ahead. For solving this task, the invention essentially consists in that the tangent lines applied to the lateral areas, extending at least over the width of the steel edges, and normally extending relative to the longitudinal direction of the ski include one with the other an obtuse angle of 170° to 179°, preferably 174° to 178°, having its apex located blow the tread and preferably in the vertical longitudinal center plane of the ski and that the width of the central area, extending in a horizontal plane as seen in a section, of the tread is greater than the total width of the chamferred areas extending in upward direction. Because the width of the middle area, extending in a horizontal plane in a cross section, of the tread is greater than the total width of the chamferred areas, the guiding effect for running straight ahead is excellent and reliably obtained. Because the tangent lines applied to the chamferred lateral areas intersect one another with a very great obtuse angle, these chamferred areas do not detract from making use of the ski edges on an icy runway, but in spite of this swinging movement is facilitated on account of the chamfer. In this case, the arrangement is preferably such that the tread includes an acute angle with the substantially plane central area of the tread at least within the area of the metal eges and extends in upward direction starting from the central area. Because the tread is in its lateral areas upwardly inclined relative to the central area, some impairment of the stability during running straight ahead must be put up with, but the capability of the ski to effect swinging movement is substantially increased. The properties for running straight ahead can easily be controlled by correspondingly designed central grooves. The increased capability of the ski to follow swinging movement on runways of widely differing conditions and, above all on loose, not bounded snow is, however, considered a great advantage.

The arrangement can preferably be such that the tread is, as seen in cross section, of bent construction at both margins. Such a bent construction, in which at both sides of the longitudinal center plane bevelled steps extending in longitudinal direction of the ski are provided, is advantageous for improving the properties for running straight ahead. Such a bevelled construction is characterized by a high degree of good guiding properties when running straight ahead beside an increased swinging property.

The steel edges being provided, as a rule, at the lateral margins of the tread of the ski are in most cases hardened or subjected to a surface treatment for obtaining good wear resistance. The arrangement is thus in a particularly preferred manner such that the bottom surfaces of the steel edges are, in an unground condition, parallely or tangentially arranged relative to the chamferred areas of the tread and are preferably flush with the chamferred areas of the tread. The chamfer shall thus not be formed by grinding the finished ski because this would influence the properties of the material of the steel edges in a disadvantageous manner.

For the purpose of the invention, i.e. the purpose of facilitating the capability of skis to follow swinging movement, it has proved sufficient if the arrangement is such that the lateral areas of the tread extend under an acute angle relative to the central area of the tread over a width corresponding to the width of the metal edges. Such a small chamfer of the lateral areas of the tread is sufficient for improving the swinging property and is scarcely of influence on the properties for running straight ahead.

The width of the upwardly extending areas of the tread is preferably smaller than 10 mm or even smaller than 5 mm. The width of a ski within the area of the ski binding is usually 65 to 70 mm. The width of an upwardly extending lateral area is thus preferably smaller than 1/7 of the width of the ski.

In the following, the invention is further explained with reference to embodiments shown in the drawing.

BRIEF DESCRIPTION OF THE DRAWINGS

FIG. 1 shows a cross section through a first embodiment of the ski according to the invention, FIG. 2 shows a partial view of a cross section through a modified embodiment and FIG. 3 shows a perspective view of a ski.

DESCRIPTION OF THE PREFERRED EMBODIMENT

In FIG. 1, there is shown a ski 1 having its tread 2 chamferred within the area of the metal edges 3, which metal edges are received in grooves 4'. The chamferred areas are designated by 4, and bevel lines 5 extending in longitudinal direction of the ski are formed between the substantially plane area 2' of the tread or base 2 and the chamferred areas 4. The chamferred areas 4 substantially extend over the area of the lateral metal edges 3 and include with the plane area 2' of the tread or base 2 an angle of 0.5° to 3°. The tangent lines applied to the lateral areas 4 intersect one another in the longitudinal center plane 6 of the ski under an angle between 170° and 179°, noting that an angle of intersetion between 174° and 178° is particularly preferred.

Each of the lateral metal edges 3 has a flange 3' which projects laterally inwardly into the ski 1 a distance at least as great as the width of the lateral chamferred area 4 receiving the metal edge.

The top surface of the ski is designated by 7 and the side surfaces, which in the representation according to the FIGS. 1 and 2 are designed to converge in upward direction, are designated by 8.

In accordance with a preferred embodiment of the invention, ski 1 comprises a top surface 7 connected to two side surfaces 8 which are further connected to a base surface 2. The base surface 2 extends with respect to a major longitudinal axis and a minor lateral axis, with the minor lateral axis defining a substantially planer surface which ends at either end of the lateral axis with steel edge members 3 connected to the base layer by lateral grooves disposed in the base layer. A substantially planar surface extends over the majority of the base portion toward the ends of the horizontal axis to lateral chamferred areas each defined by an axis extending tangential to the lateral axis and intersecting the said horizontal axis at an angle of 170° to 179° relative thereto. The chamferred areas include a portion of the base layer as well as steel edge members and define minor surfaces in relation to the base portion of the ski.

As has seen in FIG. 1, there is a longitudinally extending central running groove 11 for rendering control to the ski when running straight ahead.

In the embodiment according to FIG. 2, the side surfaces 8 are of stepped construction and the lateral areas 4 of the metal edges 3 are chamferred relative to the central area 2' of the tread 2. the lateral areas 4, which are chamferred relative to the central area 2' of the tread 2, extend over a width of approximately 5 mm.

From FIG. 3 can be seen over, which portion of the length of a ski a chamfer is provided within the area 4 of the tread 2. This area is just the area with which the ski contacts the runway and this area is designated in FIG. 3 by a.

What is claimed is:

1. A ski comprising a top surface connected to two side surfaces, said side surfaces further connected to a base surface, said base surface extending with respect to a major longitudinal axis and a minor lateral axis, said minor lateral axis defining a substantially planar surface which ends at either end of the lateral axis in steel edge members connected to the base layer by lateral grooves disposed therein;

wherein said substantially planar surface extends over the majority of the base portion toward the ends of the lateral axis to lateral chamferred areas defined by an axis tangential to the horizontal axis, the chamferred areas each intersecting said lateral axis at an angle of 170° to 179° relative thereto, said chamferred areas including a portion of the base layer as well as the steel edge members and said chamferred areas defining minor surfaces in relation to the base portion of the ski.

2. The ski as claimed in claim 1, characterized in that the bottom surfaces of the steel edge member are, in an unground condition, extend parallel.relative to the external chamferred areas of the tread and are preferably flush with the chamferred areas of the tread.

3. The ski as claimed in claim 1, characterized in that the width of chamferred lateral area of the tread is smaller than 10 mm, preferably smaller than 5 mm.

4. The ski as claimed in claim 1, characterized in that the widths of the chamferred lateral areas are less than 1/7th the width of the ski.

5. The ski of claim 1, wherein the angle that the lateral chamferred areas make with one another the horizontal axis is in the range of 174° to 178°.

6. The ski of claim 1, wherein the leading end and trailing end of the ski are angled upward and wherein the lateral chamferred areas do not extend to the leading and trailing ends of the ski.

7. The ski of claim 1, wherein the steel edge members each have an inwardly projecting flange of a width at least as great as the width of the associated lateral chamferred area, the flange being imbedded in the ski in spaced relation to the bottom surface of the associated chamferred area to help fix the steel edge members therein.

8. The ski of claim 1 wherein the base portion also contains a groove member extending along the longitudinal axis of the ski located at the mid-point of the lateral axis.

* * * * *